US010246230B2

(12) United States Patent
Sangiovanni

(10) Patent No.: US 10,246,230 B2
(45) Date of Patent: Apr. 2, 2019

(54) SAFETY CLOSURE FOR CONTAINERS

(71) Applicant: LUMSON S.P.A., Capergnanica (CR) (IT)

(72) Inventor: Mauro Sangiovanni, Palazzo Pignano (CR) (IT)

(73) Assignee: LUMSON S.P.A., Capergnanica (CR) (IT)

( * ) Notice: Subject to any disclaimer, the term of this patent is extended or adjusted under 35 U.S.C. 154(b) by 142 days.

(21) Appl. No.: 15/312,091

(22) PCT Filed: May 26, 2015

(86) PCT No.: PCT/IB2015/053937

§ 371 (c)(1),
(2) Date: Nov. 17, 2016

(87) PCT Pub. No.: WO2015/181726

PCT Pub. Date: Dec. 3, 2015

(65) Prior Publication Data

US 2017/0107027 A1 Apr. 20, 2017

(30) Foreign Application Priority Data

May 29, 2014 (IT) ..... MI2014A0995

(51) Int. Cl.
*B65D 51/20* (2006.01)
*B65D 51/18* (2006.01)
(Continued)

(52) U.S. Cl.
CPC ..... *B65D 51/20* (2013.01); *A45D 33/003* (2013.01); *A45D 40/0068* (2013.01);
(Continued)

(58) Field of Classification Search
CPC .. B65D 51/20; B65D 51/228; B65D 43/0249; B65D 2251/0078; B65D 2251/0081;
(Continued)

(56) References Cited

U.S. PATENT DOCUMENTS 2,446,451 A * 8/1948 Allen ..... A61J 9/005 215/11.1
3,071,281 A * 1/1963 Sawai ..... B65D 15/14 220/258.3
(Continued)

FOREIGN PATENT DOCUMENTS

EP 0348102 A1 12/1989
JP H11255251 A 9/1999
WO 2013088422 A2 6/2013

*Primary Examiner* — James N Smalley
(74) *Attorney, Agent, or Firm* — King & Schickli, PLLC

(57) ABSTRACT

A safety closure for containers comprising a cover (3) and an internal element (4), the internal element being formed of a constraining portion (5) and a covering portion (6), the covering portion and the constraining portion being at least partially interconnected by means of at least a first preferential breakage zone (7B) which, when intact, joins them to each other, the constraining portion being provided with blocking means at the neck of a container with which the closure is intended to be associated and with first constraining means (10) which removably attach the cover, the internal element having sealing means (12) which, at least when the seal is intact, preserve the container content integrity.

19 Claims, 4 Drawing Sheets

(51) Int. Cl.

| | |
|---|---|
| ***A45D 33/00*** | (2006.01) |
| ***A45D 40/00*** | (2006.01) |
| ***B65D 43/02*** | (2006.01) |
| ***B65D 51/22*** | (2006.01) |

(52) U.S. Cl.
CPC ..... *B65D 43/0249* (2013.01); *B65D 51/18* (2013.01); *B65D 51/228* (2013.01); *B65D 2251/009* (2013.01); *B65D 2251/0015* (2013.01); *B65D 2251/0018* (2013.01); *B65D 2251/0078* (2013.01); *B65D 2251/0081* (2013.01); *B65D 2251/0093* (2013.01)

(58) Field of Classification Search
CPC ..... B65D 2251/0015; B65D 2251/009; B65D 2251/0018; B65D 2251/0093; A45D 40/0068; A45D 33/003
USPC ..... 222/478, 562; 220/270, 276; 215/320, 215/321
See application file for complete search history.

(56) References Cited

U.S. PATENT DOCUMENTS

| | | | | |
|---|---|---|---|---|
| 5,038,948 | A * | 8/1991 | Signorini | A61J 9/00 215/11.1 |
| 5,593,054 | A * | 1/1997 | Glynn | B65D 50/062 215/206 |
| 2003/0010781 | A1 * | 1/2003 | Odet | B65D 41/185 220/258.2 |
| 2003/0192891 | A1 * | 10/2003 | Ziegler | A47G 19/2272 220/288 |

* cited by examiner

SAFETY CLOSURE FOR CONTAINERS

TECHNICAL FIELD

The present invention relates to a safety closure for containers.

In particular, it relates to a closure to be used on containers of cosmetic products, especially creams, makeup products, medical products, drugs and the like.

BACKGROUND

As is known, creams are packaged in specific containers which have a very large mouth for directly accessing the contents by means of the user's fingers. For this reason, cream containers are not very high but are very wide. They usually have a cover screwed onto the container. In order to ensure the integrity of the product before opening, an aluminum sheet is provided below the cover, which is sealingly fixed to the mouth of the container and which is to be removed before the first use of the cream. The aluminum sheet ensures the integrity of the product.

Normally, the aluminum sheet is only partially detached from the mouth, and once used is complete, it is spread out again over the surface of the cream; the cover is then placed. Thereby, an attempt is made to avoid soiling the face of the cover facing the cream, with the cream itself. After some use however, the aluminum foil curls up in the container and gets soiled with cream, which is then also transferred to the cover, thus creating an unpleasant and disorderly situation.

Other cosmetic products, such as for example face powder or compact powder cosmetics, are packaged in containers including a rigid or clear plastic disk, to be positioned over the product; the disk is placed directly in contact with the product, or is rested on the edges of the opening. The solution is certainly an improvement in terms of orderliness as compared the previous one; however, the integrity of the product cannot be ensured with this system.

SUMMARY

It is the object of the prevent invention to provide a closure for containers which is enhanced with respect to those currently known.

It is a further object of the invention to provide a safety closure which allows the user to check the integrity of the product purchased.

It is a further object of the invention to provide a closure capable of protecting the product contained therein, in an optimal manner also after the first opening, thus protecting the container cover from contaminating the product contained therein.

It is yet a further object of the present invention to provide a closure which accelerates and facilitates the operations of securing it on the container once it is filled.

This and other objects are achieved by a closure provided according to the technical teachings of the appended claims.

BRIEF DESCRIPTION OF DRAWINGS

Further features and advantages of the invention will become more apparent from the description of a preferred, but not exclusive, embodiment of the device, disclosed by way of non-limiting example, with the aid of the accompanying drawings, in which.

DETAILED DESCRIPTION

Figure 1:
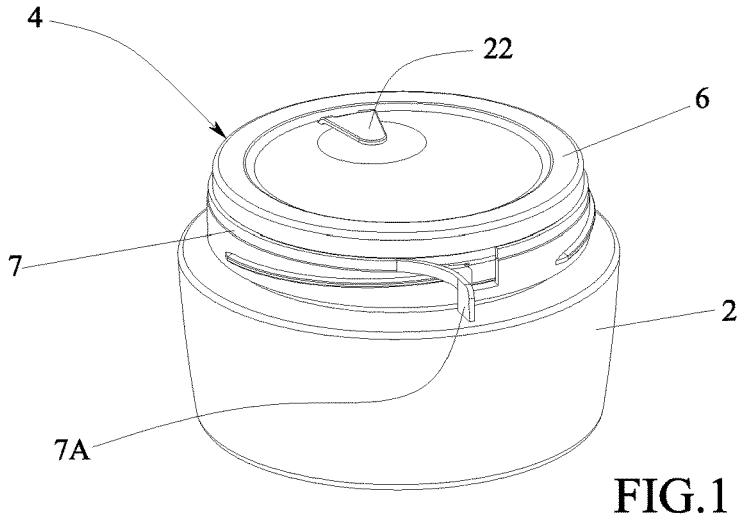
FIG. 1 is a perspective view of a container with which a part of the closure according to the present invention is associated, in a step in which it is to be opened for the first time.

With reference to the figures mentioned, a closure is shown, indicated with reference numeral 1 as a whole.

Figure 2:
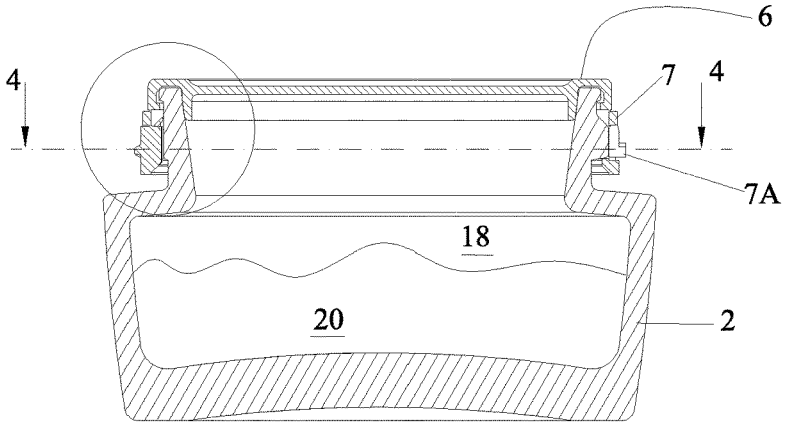
FIG. 2 is a diametral section of the container in FIG. 1, taken along line 2-2 in FIG. 4.
Figure 3:
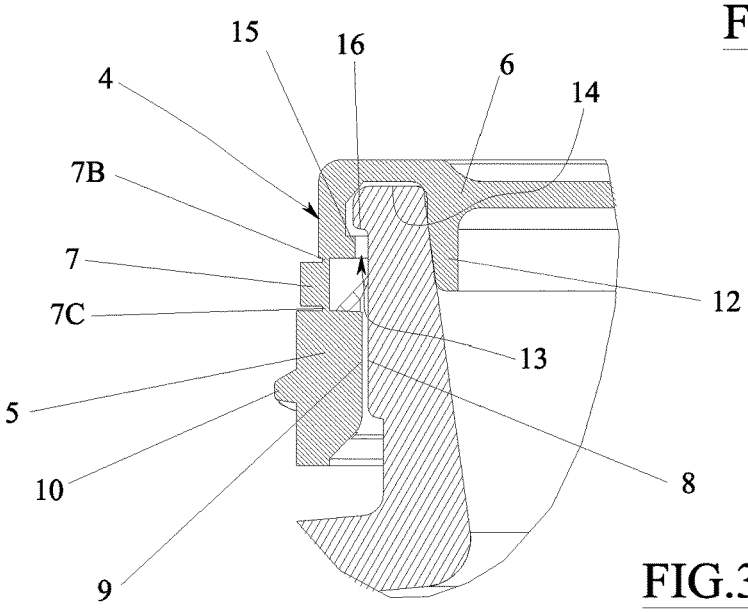
FIG. 3 is an enlarged sectional view of the detail enclosed in the circle in FIG. 1.
Figure 5:
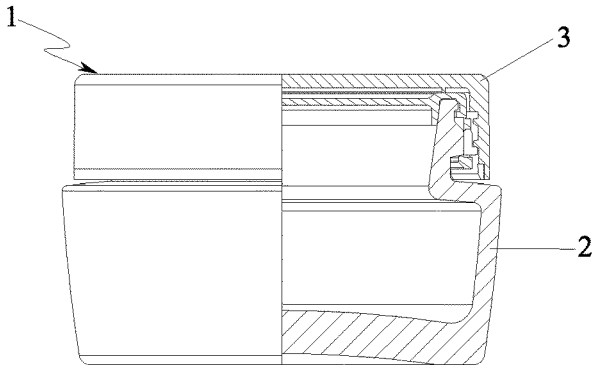
FIG. 5 is a partial section of the container in FIG. 1, to which the closure of the present invention is applied.
Figure 6:
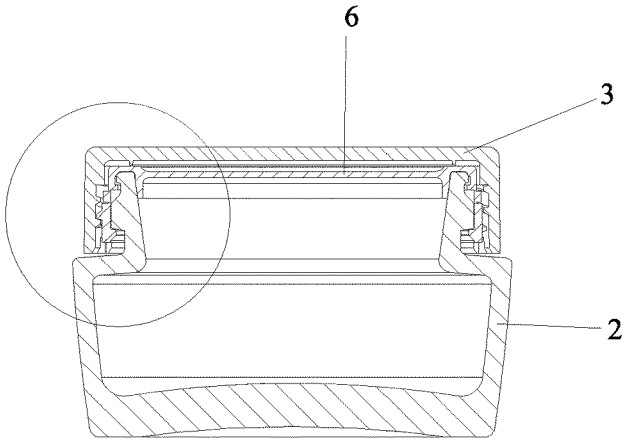
FIG. 6 is a section taken along line 6-6 in FIG. 4.

The safety closure in FIG. 5 is positioned on a container 2 comprising a cover 3 and an internal element 4, which is clearly seen in FIGS. 1, 2 and 3.

The internal element 4 is made in a single piece by injection molding of plastics e.g selected among PP, PE, LDPE, HDPE, TPE, RUBBER, PE LOADED RUBBER, PP LOADED RUBBER, and comprises a ring-shaped constraining portion 5 and a substantially discoidal covering portion 6, which are at least partially interconnected to a removable seal 7, which, when intact, joins them to each other (FIG. 3).

The seal is joined to the constraining portion 5 and to the covering portion 6, respectively, by means of a first 7B and a second 7C preferential breaking zone. In the embodiment described, the preferential breaking zones 7B, 7C are made by thinning the plastic of which the internal element is made, but obviously providing breaking lines in which small cuts alternate solid portions is also possible.

Figure 7:
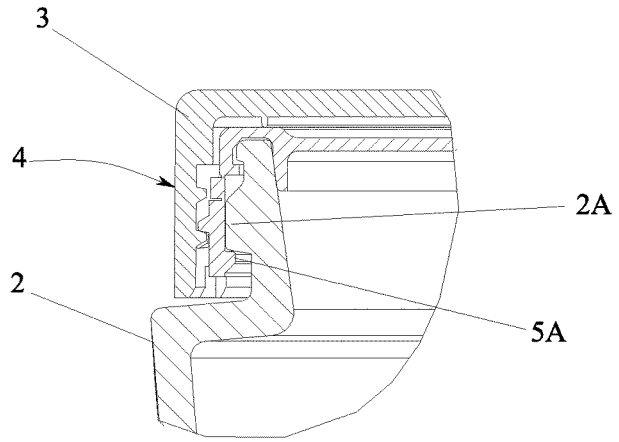
FIG. 7 shows the detail enclosed in the circle in FIG. 6, enlarged.

In the detail in FIG. 7, the constraining portion is provided with blocking means at the neck of container 2 with which the closure is intended to be associated. Specifically, the constraining portion engages in an undercut and snaps on the neck of the container, thus engaging an annular protuberance 2A specifically made on the latter.

As a result of how they are configured, the blocking means are thus of the unremovable undercut type, with snap-engagement. When the internal element is pushed onto the neck of the container, a tooth 5A thereof (actually an even discontinuous, annular edge) made on the constraining element 5 slides over the annular protuberance 2A of the container and snaps in the undercut below it.

Herein, the term "unremovable" means that once the constraining element 5 has been coupled to container 2, it can no longer be separated from the latter during "ordinary" use. Obviously, container 2 and the constraining element 5 may be separated by levering or exerting a force on the constraining element 5, which force is greater than that acting during normal use.

Figure 4:
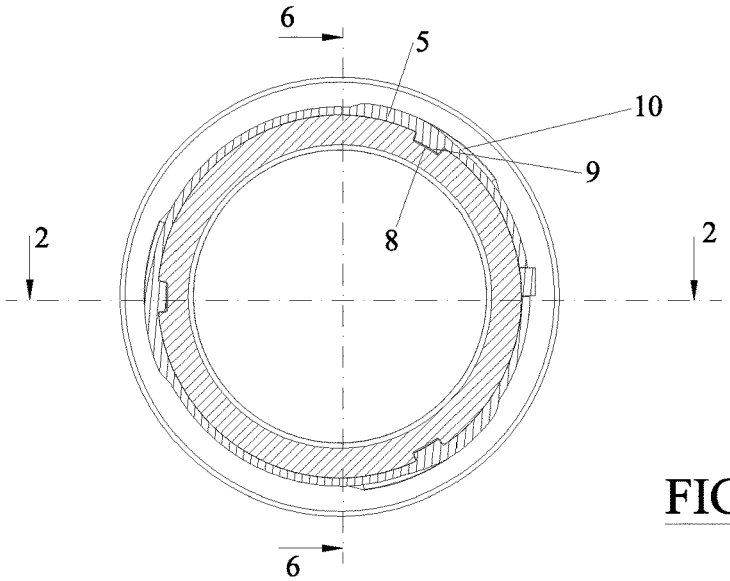
FIG. 4 is a section taken along line 4-4 in FIG. 2.

As is appreciated in the section in FIG. 4, the annular protuberance 2A of container 2 has recesses 9 in which projections 9 of the constraining element 5 are accommodated. Obviously, the protuberance may also have projections and the constraining element may have recesses. In any case, recesses and projections form torsional coupling means between the container and the constraining portion, so that once the constraining portion and the container have been coupled, the constraining portion 5 cannot rotate with respect to the container.

Indeed, there is a thread 10 on the constraining portion, which acts as a removable constraining means for cover 3, which is actually screwed thereon.

It is worth noting that the internal element 4 has sealing means 12, which mainly prevent the content of the container itself (which may be a cream, a cosmetic makeup product in the form of paste or powder, a gel, a foundation, a pharmaceutical or nutraceutical product in the form of pills or tablets) from leaking when the internal element 4 is positioned thereon, and seal 7 is intact. The content of the container is thus preserved by the closure.

The sealing means may also prevent the external air from penetrating inside the container, if the product contained therein is perishable or needs to be protected from the surrounding ambient air.

As clearly shown in FIG. 3, the sealing means are advantageously located on the covering portion 6 and specifically comprise an annular lip 12 projecting from the covering portion and adapted to cooperate with an internal edge of a mouth of container 2.

However, the sealing means may obviously also be located directly between the constraining portion and the covering portion. Also in this manner, in fact, they may preserve the content of container 2.

FIG. 2 shows that the internal element 4 ensures the integrity and originality of the product contained in container 2, at least when seal 7 is intact.

It is worth noting that the covering portion 6 has an annular groove 13 adapted to cooperate with a free edge 14 of the container for the reciprocal centering between the covering portion and the container. The utility of such a centering will be clarified below.

The covering portion 6 advantageously has removable anchoring means with the container, which comprise for example an edge 15 (also discontinuous) adapted to cooperate in an undercut with a flange 16 specifically provided on said container.

Obviously, the removable anchoring means may alternatively be provided between the constraining portion 5 (since it is integral with the container) and the covering portion 6.

The operation of the invention is apparent for those skilled in the art from the above description, and it is substantially as follows.

A cavity 18 of container 2 is filled in advance with a product 20. The internal element 4 is then pressed onto the mouth of container 2 until tooth 5A snaps below the annular protuberance 2A, thus blocking the internal element at the neck of container 2.

The annular lip 12 partially penetrates inside the mouth of container 2, and actually seals it by providing a seal against an inner surface thereof.

In the case of products which are not sensitive to the air, the annular lip may simply preserve the product, in the sense that it prevents it from leaking out of the container.

It is worth noting that the internal element 4 was aligned in advance so that the recesses 8 of the protuberance correspond with the projections 9 of the internal element (and specifically of the constraining element 5).

Cover 3 is then screwed onto the internal element, or better onto the thread 10 of the constraining element 5.

When a user wants to use product 20, he/she unscrews the cover 3, thus being in the configuration in FIG. 1. At this point, he/she grasps the free end (or tab) 7A of seal 7 and pulls it with a rotational movement about the container, thus detaching the seal from the constraining portion 5 and from the covering portion 6.

Figure 9:
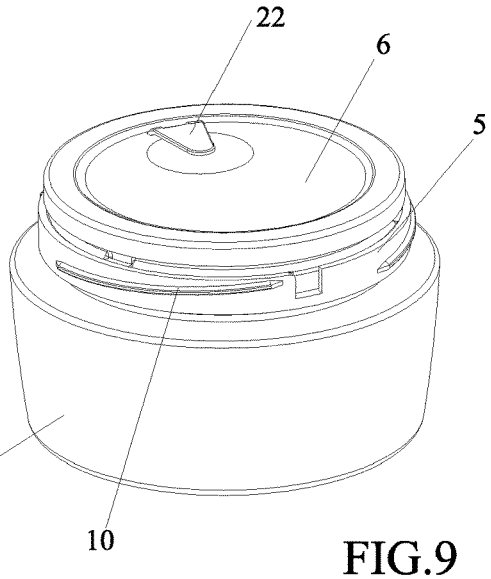
FIG. 9 shows the closure of the present invention in an intermediate configuration, adapted to preserve the product contained in the container before a permanent closing.
Figure 10:
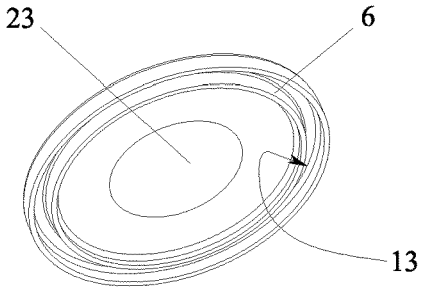
FIG. 10 shows a perspective bottom view of a part of the closure according to the present invention.
Figure 11:
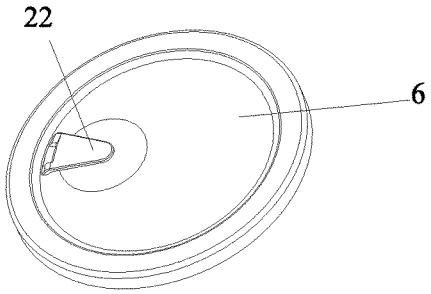
FIG. 11 is a top view of the part shown in FIG. 10.

Therefore, the configuration shown in FIG. 9 is obtained, where it is noted that seal 7 is no longer present, and the constraining portion and the covering portion are physically separated (since the preferential breaking zones allowed seal 7 to be detached).

The user may thus grasp the flexible leg 22 molded on the covering portion 6, thus lifting the latter from the container. In the embodiment shown, there is a need to exert a minimum force on leg 22, since edge 15 must be disengaged from flange 16 in order to separate the closure portion from the container. Actually, this operation is quite easy, as the flange/edge coupling is precisely dimensioned to allow an easy detachment of the two parts, while allowing the closure portion to remain in position when it is on container 2.

Figure 8:
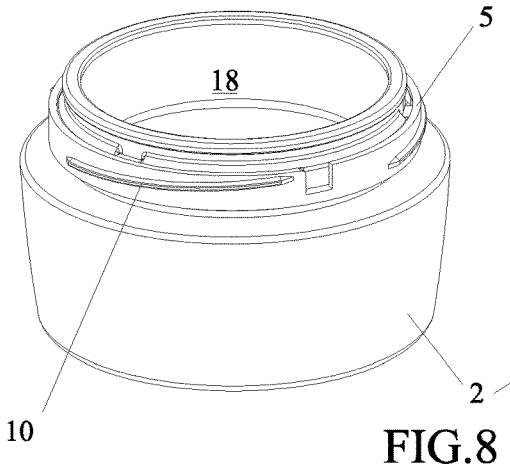
FIG. 8 shows the closure of the present invention in a completely open configuration.

Therefore, the user has direct access to the cavity 18 of the container (FIG. 8).

Once the use of product 20 is ended, the covering portion 6 (now serving the function of plate) may be positioned again on container 2, and cover 3 may be screwed to permanently close the container, thus protecting the product therein.

It is worth noting that a closure 1 like that described ensures, for the final user, that the container is intact and was not opened before being used. Indeed, the internal element 4 is assembled on the neck of the container, once the latter has been filled, by means of a closure system with snap fitting.

To the eyes of the end user, the outside of the container has a fully traditional appearance.

The closure may advantageously have, in the part of the covering portion 6 facing the inside of the container, an indicator 23, e.g. of the film type, which changes appearance according to the air exposure time. Therefore, the indicator provides an indication of the air exposure time of the film, and hence of the content. This may be useful both as a further indication of the product integrity, and used in relation to the expiry date of the product.

The internal element 4 may obviously be applied to rigid plastic or glass containers; whereas cover 3 serves a purely aesthetical function. The latter may have mechanical stops obtained on the constraining element, which facilitate and/or ensure the alignment between the body of the container and the cover in the packaging configuration with non-circular sections.

The described closure may obviously be assembled on light-weight, rigid containers, and acquire in this configuration a refilling function for costly containers and products. Furthermore, transport savings are ensures in the refilling solution due to the reduced weight in the case of glass containers or the like. In this solution, the container may be sold as a refill for a more costly container with consequent transport savings due to the reduction of weight and the materials used.

The user may purchase the costly container and once the product has been finished, he/she may have the sealed container sent home with the new product, thus keeping the cover and the external container.

Furthermore, with this technique, containers with a high added value may be made in the reference market, and the transport of the container alone with country-of-origin seal may be carried out.

It is worth noting that the above-described closure highly facilitates the step of filling the container because it introduces a "snap" closure system, thus eliminating the screwing step.

The "snap" closure is faster and safer than the screw closures, and ensures certain closure forces and heights. Screw closures must be tightened with different closing torques according to the material and thickness of the sealing element used.

Instead, when positioned on the container, the closure described ensures the sealing effect as soon as is "snaps" on the latter.

Figure 15:
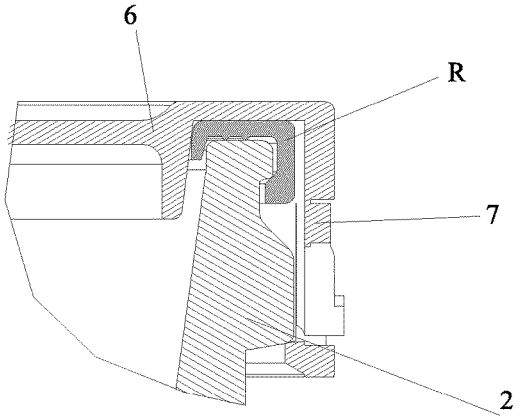
FIG. 15 is an enlarged sectional view of a detail of a different embodiment of the invention.

In the case of rigid containers, where the dimensional tolerances are not ensured, a component (reducer) R may be introduced on the mouth of the container before the snap fitting step (see FIG. 15), which is actually a ring surrounding the mouth of the container and fixed to the edge which defines it. Such a component exerts a function for calibrating the heights and diameters of the neck in order to facilitate the sealing effect of the closure.

When the internal element 4 is snap fitted, the reducer remains sandwiched between the container and the internal element itself.

Figure 12:
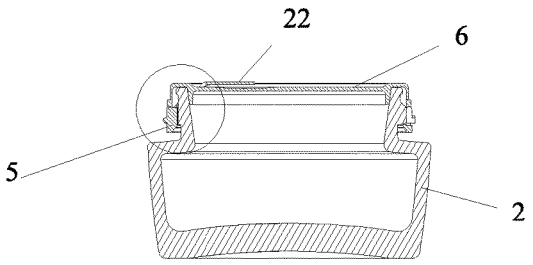
FIG. 12 is a diametral section of a container with which a part of a different embodiment of a closure according to the invention is associated.
Figure 14:
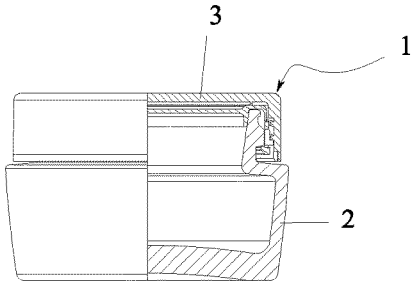
FIG. 14 is a partially section view of a jar with which the complete closure, partially depicted in FIG. 12, is associated.
Figure 13:
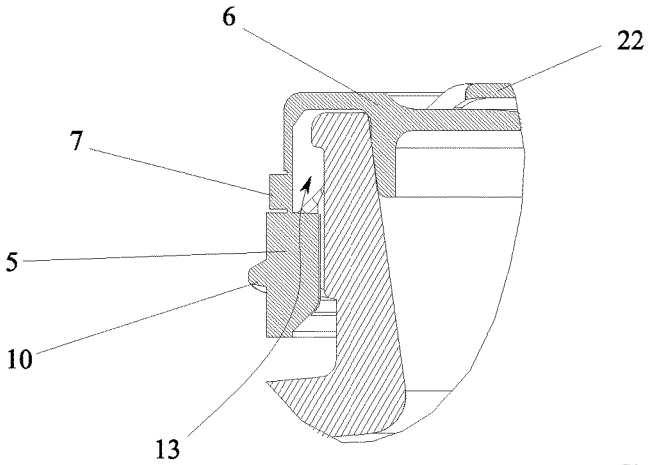
FIG. 13 is an enlargement of the detail enclosed in the circle in FIG. 12.

FIGS. 12 to 14 show a different embodiment of the invention. In such figures, the same reference numerals previously used are used to indicate functionally similar parts, the description of which will not be repeated.

According to an alternative embodiment of the invention, the covering portion 6 has an annular groove which is wider than that described above and which is free from the edge 15, which is coupled to the flange.

In fact, when the closure portion is positioned on the container, it simply rests on the free edge of the latter.

Various embodiments of the invention have been described, but many more could be conceived by taking advantage of the same innovative concept.

Therefore, for example, a closure without a removable seal may be provided, in which the covering portion 6 and the constraining portion 5 are directly connected by means of a preferential breaking zone or part. In this case, in order to open the container, it is sufficient to act on the closure portion to separate it from the constraining portion, thus breaking the preferential breaking zone.

The invention claimed is:

1. A safety closure for containers comprising a cover and an internal element, the internal element being formed by a constraining portion and by a covering portion, that after use may be positioned again on the container, the covering portion and the constraining portion being interconnected by at least a first preferential breakage zone which, when intact, joins them to each other, the constraining portion being provided with blocking means at the neck of a container with which the closure is intended to be associated, and first removable constraining means associated with the cover, the internal element having sealing means which, at least when the seal is intact, preserve the container content integrity;

wherein the sealing means is located on the covering portion and/or wherein the sealing means comprises an annular lip projecting from the covering portion and adapted to cooperate with an internal edge of a mouth of the container with which the closure is intended to be associated;

wherein the covering portion may be reapplied and covered by the cover.

2. The closure of claim 1, wherein the internal element comprises a removable seal joined to the covering portion and to the constraining portion, respectively, by means of the first preferential breaking zone and a second preferential breaking zone.

3. The closure of claim 1, wherein the covering portion has an annular groove adapted to cooperate with a free edge of the container for the reciprocal centering between the covering portion and the container, when the covering portion is on the container, and/or wherein the covering portion has removable anchoring means with said container and/or with said constraining portion, and/or wherein said removable anchoring means comprises at least one edge adapted to cooperate in an undercut with a flange suitably located on said container and/or on said constraining portion.

4. The closure of claim 1, wherein the blocking means are of an unremovable undercut type, with a snap-engagement and/or wherein the blocking means have torsional coupling means between the container and the constraining portion.

5. The closure of claim 4, wherein the torsional coupling means have projections or recesses cooperating with recesses or projections obtained in the container.

6. The closure of claim 1, wherein the removable constraining means comprise a thread adapted to cooperate with a corresponding counter-thread located on the cover.

7. The closure of claim 1, wherein the internal element is made in a single piece, by injection molding of plastics.

8. A closure-container system comprising a container on which a closure is positioned according to claim 1.

9. The system of claim 8, wherein the container has an annular protuberance for the coupling with said anchoring means, and/or wherein the annular protuberance is provided with recesses or projections for housing projections or recesses of the constraining portion.

10. A safety closure for containers comprising a cover and an internal element, the internal element being formed by a constraining portion and by a covering portion, that after use may be positioned again on the container, the covering portion and the constraining portion being interconnected by means of at least a first preferential breakage zone which, when intact, joins them to each other, the constraining portion being provided with blocking means at the neck of a container with which the closure is intended to be associated, and first removable constraining means associated with the cover, the internal element having sealing means which, at least when the seal is intact, preserve the container content integrity;

wherein the covering portion has an annular groove adapted to cooperate with a free edge of the container for the reciprocal centering between the covering portion and the container, when the covering portion is on the container, and/or wherein the covering portion has removable anchoring means with said container and/or with said constraining portion, and/or wherein said removable anchoring means comprises at least one edge adapted to cooperate in an undercut with a flange suitably located on said container and/or on said constraining portion.

11. The closure of claim 10, wherein the sealing means is located on the covering portion and/or wherein the sealing means comprises an annular lip projecting from the covering portion and adapted to cooperate with an internal edge of a mouth of the container with which the closure is intended to be associated.

12. The closure of claim 10, wherein the blocking means is of an unremovable undercut type, with a snap-engagement and/or wherein the blocking means includes torsional coupling means between the container and the constraining portion.

13. The closure of claim 12, wherein the torsional coupling means includes projections or recesses cooperating with recesses or projections of the container.

14. A closure-container system comprising a container on which a closure is positioned according to claim 10.

15. The system of claim 14, wherein the container has an annular protuberance for the coupling with said anchoring means, and/or wherein the annular protuberance is provided with recesses or projections for housing projections or recesses of the constraining portion.

16. A safety closure for containers comprising a cover and an internal element, the internal element being formed by a constraining portion and by a covering portion, that after use may be positioned again on the container, the covering portion and the constraining portion being interconnected by means of at least a first preferential breakage zone which, when intact, joins them to each other, the constraining portion being provided with blocking means at the neck of a container with which the closure is intended to be associated, and first removable constraining means associated with the cover, the internal element having sealing means which, at least when the seal is intact, preserve the container content integrity;

wherein the blocking means is of an unremovable undercut type, with a snap-engagement and/or wherein the blocking means includes torsional coupling means between the container and the constraining portion;

wherein the torsional coupling means includes projections or recesses cooperating with recesses or projections obtained in the container;

wherein the covering portion may be reapplied and covered by the cover.

17. The closure of claim 16, wherein the sealing means is located on the covering portion and/or wherein the sealing means comprises an annular lip projecting from the covering portion and adapted to cooperate with an internal edge of a mouth of the container with which the closure is intended to be associated.

18. A closure-container system comprising a container on which a closure is positioned according to claim 16.

19. The system of claim 16, wherein the container has an annular protuberance for the coupling with said anchoring means, and/or wherein the annular protuberance is provided with recesses or projections for housing projections or recesses of the constraining portion.

* * * * *